United States Patent [19]

Sevec

[11] 4,093,835

[45] June 6, 1978

[54] ROTATION SENSOR SWITCH

[75] Inventor: John B. Sevec, Joliet, Ill.

[73] Assignee: The United States of America as represented by the United States Department of Energy, Washington, D.C.

[21] Appl. No.: 784,401

[22] Filed: Apr. 4, 1977

[51] Int. Cl.[2] ..... H01H 35/02

[52] U.S. Cl. ..... 200/61.45 M; 200/61.46; 335/205

[58] Field of Search ..... 335/205; 200/61.45 R, 200/61.45 M, 61.46

[56] References Cited

U.S. PATENT DOCUMENTS

| | | | |
|---|---|---|---|
| 2,802,204 | 8/1957 | Kennelly et al. | 200/61.45 R X |
| 3,813,505 | 5/1974 | Shoji | 200/61.45 M X |
| 4,028,516 | 6/1977 | Hirashima et al. | 200/61.45 M |

*Primary Examiner*—George Harris

*Attorney, Agent, or Firm*—Dean E. Carlson; Frank H. Jackson; Donald P. Reynolds

[57] ABSTRACT

A protective device to provide a warning if a piece of rotating machinery slows or stops comprises a pair of hinged weights disposed to rotate on a rotating shaft of the equipment. When the equipment is rotating, the weights remain in a plane essentially perpendicular to the shaft and constitute part of an electrical circuit that is open. When the shaft slows or stops, the weights are attracted to a pair of concentric electrically conducting disks disposed in a plane perpendicular to the shaft and parallel to the plane of the weights when rotating. A disk magnet attracts the weights to the electrically conducting plates and maintains the electrical contact at the plates to complete an electrical circuit that can then provide an alarm signal.

3 Claims, 2 Drawing Figures

ROTATION SENSOR SWITCH

CONTRACTUAL ORIGIN OF THE INVENTION

The invention described herein was made in the course of, or under, a contract with the UNITED STATES ENERGY RESEARCH AND DEVELOPMENT ADMINISTRATION.

BACKGROUND OF THE INVENTION

This invention is a protective device for electrical equipment. More particularly, this equipment provides an alarm signal if a piece of rotating equipment stops rotating and it uses essentially no electrical energy unless it is providing an alarm.

Many items of electrical equipment are expected to run with little or no attention for long periods of time and do so successfully. Some of these items of equipment can lead to relatively annoying complications if a brief power interruption or a circuit failure causes the equipment to stop without providing an alarm to alert an operator. In particular this is true of vacuum systems in which a mechanical pump is driven by an electric motor. A power failure affecting a vacuum pump can lead to stalling of the pump or belt damage if the pump is started after power has been restored. If the mechanical pump is a fore pump in a high-vacuum system which includes an oil diffusion pump, then there is an added possibility of oxidation of pump oil when the diffusion pump continues to receive power when the mechanical pump is not maintaining an adequate fore vacuum. Prompt work by an operator who is informed of such operating difficulties can prevent damage to equipment and can lead to the early restoration of proper operation. However, many such installations do not warrant the presence of an operator to watch at all times for such failures. It would be useful to have an inexpensive system to provide an alarm if such a pump stopped. It would be even more advantageous if the system that provided the alarm used no energy except when it was providing the alarm.

It is an object of the present invention to provide an inexpensive alarm system for rotating equipment.

It is a further object of the present invention to provide an alarm for rotating equipment that uses no energy except when the system is stopped and it is desired to produce an alarm.

Other objects will become apparent in the course of a detailed description of the invention.

SUMMARY OF THE INVENTION

An alarm to alert the cessation of rotation of rotating equipment comprises a pair of rotating ferromagnetic weights adapted to rotate in a plane perpendicular to the axis of the rotating shaft without disturbing the balance of the shaft and hinged near the shaft to permit rotation with respect to the shaft in a plane containing the axis of the shaft. An electrically conducting disk and an annular strip about the disk, both disposed in a plane perpendicular to the shaft, are placed near and parallel to the plane of the rotating weights and are backed with a disk magnet. Distances and field strengths are adjusted so that, when the shaft is rotating at speed, the weights remain in a single plane and are free of the conducting disk and strip. When the rotating shaft slows or stops, the attractive force of the disk magnet causes the weights to move about their hinges and contact the electrically conducting disk and strip. One of the weights has an extender to contact the conducting strip and the other weight is permitted to contact the conducting disk. An electrical connection between the two weights completes an electric circuit between the conducting strip and the conducting disk, completing an electric circuit to sound an alarm. The electrical connection between the weights may be made through a connecting wire between the arms supporting the weights or it may be made through hinges providing pivotal motion for the weights and a frame supporting those hinges.

DETAILED DESCRIPTION OF THE INVENTION

Figure 1:
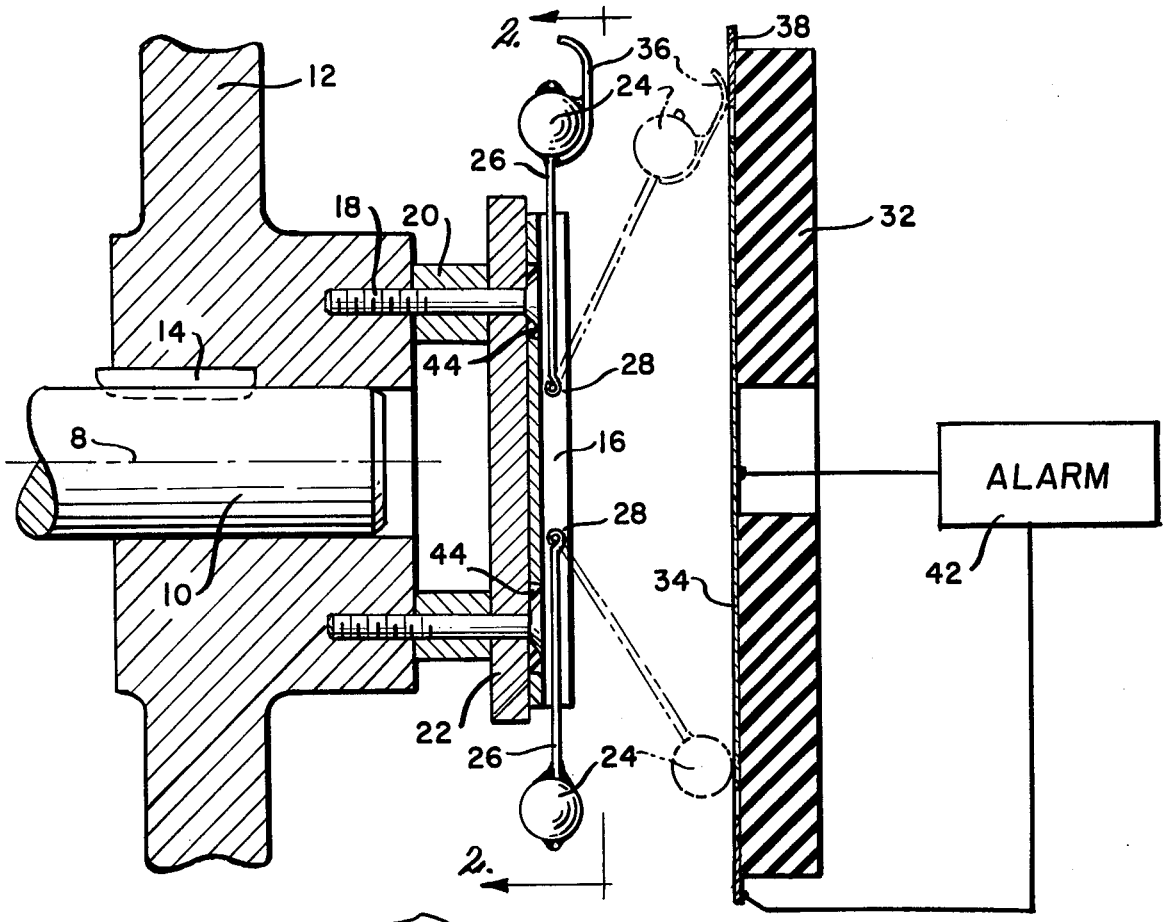
FIG. 1 is a sectional side view of the present invention taken along the axis of a shaft of the equipment to be protected.
Figure 2:
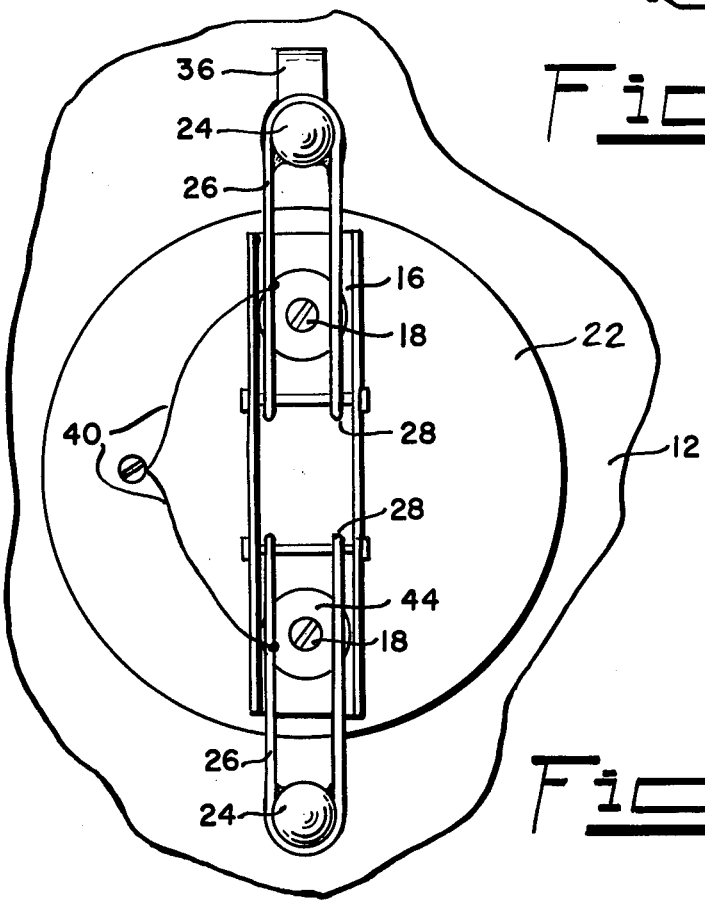
FIG. 2 is an end view of the pivoted weights of FIG. 1.

FIG. 1 is a sectional side view of the apparatus of the present invention taken along the axis of rotation 8 of the electrical equipment to be protected, and FIG. 2 is a sectional end view along section lines 2—2 of FIG. 1. In FIG. 1, shaft 10 is part of the equipment to be protected. It is connected to a pulley 12 through key 14. Pulley 12 is typically a drive pulley for a vacuum pump or some similar piece of equipment that normally operates unattended with little threat of failure but that can cause annoying complications if it stops. The present invention provides an alert if shaft 10 slows or stops. To accomplish this, mounting plate 16 is attached by screws 18 to pulley 12. Bushings 20 space frame 22 away from pulley 12. Two ferromagnetic weights 24 are attached by brackets 26 to hinges 28 which, in turn, are connected to mounting plate 16. Two positions are shown for the weights 24 in FIG. 1. In the first of these, shaft 10 is presumed to be turning about its axis 8 and the weights 24 are thrown centrifugally into a plane perpendicular to axis 8. In the second position, it is supposed that shaft 10 has slowed or stopped. The weights 24 have pivoted about the hinges 28, attracted out of their planar relationship by disk magnet 32, which is magnetized to produce a field parallel to axis 8. One of the weights 24 is seen to have been pulled toward disk magnet 32 and to have made contact with conducting disk 34. The other weight 24 is also attracted by disk magnet 32 until extended contact 36 touches conducting disk 38. Electrical continuity is thus established between conducting disk 34 and conducting strip 38 through a path that includes extended contact 36, one of the weights 24, one of the brackets 26, wire 40 which is attached from one bracket 26 to the other bracket 26, thence to the other weight 24 to complete the connection. The connection of an external alarm 42 between conducting strip 38 and conducting disk 34 is thus effected to provide a signal to alert an operator to the fact that shaft 10 has stopped turning. Weights 24 are shown as spheres which make smooth sliding contact with conducting disk 34. This shape is unimportant beyond the consideration of making nondestructive sliding electrical contact.

It may be desirable to isolate electrically those portions of the apparatus included in the alarm from pulley 12. This may be accomplished either by making hinges 28 of an insulating material and connecting the two brackets 26 by wire 40 or it may be accomplished by establishing an electrical connection through a hinge 28 through mounting plate 16 to the other hinge 28, and thence to the other bracket 26. In such a case, it will be necessary to assure the breaking of electrical continuity between mounting plate 16 and pulley 12. This is readily done by making mounting plate 16 of an insulating material such as a plastic and by placing insulating washers 44 between each screw 18 and mounting plate 16. It would also be possible to make screws 18 of electrically insulating material.

An alternative method of operation of the invention is to establish a connection to electrical ground through the equipment to be protected. This is most readily done by removing insulating washer 44 so that mounting plate 16 is connected electrically to pulley 12 through screws 18. This requires only one connection with weights 24 instead of the former two, eliminating the need for extended contact 36 and conducting strip 38. Both weights 24 can be allowed to make electrical contact with conducting disk 34 upon the slowing or stopping of shaft 10 to operate alarm 42. As before, electrical contact can be made either through hinges 28 or through wire 40 to complete the circuit.

Operation of the circuit also is facilitated by placing disk magnet 32 as close to mounting plate 16 as possible without attracting the weights 24 when shaft 10 is turning. This can be accomplished by moving disk magnet 32 in toward shaft 10 until it attracts weights 24 when the shaft is turning. Backing disk magnet 32 off just enough to free the weights 24 will establish an operating location into which disk magnet 32 and the conducting plates 34 and 38 may be fixed for best operation.

It is evident from inspection of FIGS. 1 and 2 that the structures attached to pulley 12 can be small enough and light enough to place a negligible energy burden on the system and, further, that alarm 42 need conduct no current until the establishment of a closed circuit through alarm 42 indicates that shaft 10 has slowed or stopped. The apparatus is thus characterized by a minimum energy demand except for the time when it is indicating a need for corrective action.

The embodiments of the invention in which an exclusive property or privilege is claimed are defined as follows:

1. A switch to operate an apparatus for providing an alarm when a rotating shaft slows comprising:

a pair of ferromagnetic weights;

a pair of electrically conducting brackets, each connected at a first end to one of the pair of ferromagnetic weights;

a pair of hinges connected in a fixed spatial relation to the shaft in a plane perpendicular to an axis of rotation of the rotating shaft and equidistant from the axis of rotation, each one of the pair of hinges connected to a second end of one of the pair of electrically conducting brackets, the hinges placed to permit rotation of the ferromagnetic weights about the hinges in a plane containing the axis of rotation of the rotating shaft, the hinges further supporting the weights in balanced rotation in a plane perpendicular to the axis of the rotating shaft;

a conducting disk disposed concentrically with and perpendicular to the axis of the rotating shaft at a distance from the plane perpendicular to the axis of the shaft that is less than the length of the combination of one each of the weights and the brackets; and a disk magnet touching the conducting disk on a side away from the weights, the disk magnet disposed and magnetized in a direction to attract the weights toward the conducting disk whereby the ferromagnetic weights are attracted by the disk magnet to the conducting disk to make electrical contact as a switch from the conducting disk through the weights, the brackets, and the hinges when the rotating shaft slows.

2. The apparatus of claim 1 comprising in addition means connecting the hinges electrically to the shaft, whereby an electrical connection is established between the conducting disk and the rotating shaft when the rotating shaft slows.

3. The apparatus of claim 1 comprising in addition:

a conducting strip disposed in the plane of the conducting disk, in an annular position about the conducting disk, and insulated electrically therefrom;

an extended contact connected to one of the ferromagnetic weights, the contact having a length sufficient to reach the conducting strip when the ferromagnetic weights are attracted by the disk magnet; and a wire connecting the conducting brackets, whereby an electrical connection is established between the conducting disk, one of the ferromagnetic weights, one of the brackets, the wire, the other of the brackets, the other of the ferromagnetic weights, the extended contact, and the conducting strip.

* * * * *